US010584475B1

(12) United States Patent
Idd

(10) Patent No.: US 10,584,475 B1
(45) Date of Patent: Mar. 10, 2020

(54) METHOD AND SYSTEM FOR CONSTRUCTION AND BUILDING

(71) Applicant: Soleman Abdi Idd, Washington, DC (US)

(72) Inventor: Soleman Abdi Idd, Washington, DC (US)

( * ) Notice: Subject to any disclaimer, the term of this patent is extended or adjusted under 35 U.S.C. 154(b) by 0 days.

(21) Appl. No.: 16/445,301

(22) Filed: Jun. 19, 2019

(51) Int. Cl.
*E04B 1/16* (2006.01)
*E04B 1/04* (2006.01)
*E04C 2/04* (2006.01)
*E04B 5/38* (2006.01)

(52) U.S. Cl.
CPC ..... *E04B 1/165* (2013.01); *E04B 1/043* (2013.01); *E04B 5/38* (2013.01); *E04C 2/044* (2013.01)

(58) Field of Classification Search
CPC . E04B 1/165; E04B 5/38; E04B 1/043; E04C 2/044
See application file for complete search history.

(56) References Cited

U.S. PATENT DOCUMENTS 3,559,355 A 2/1971 Day, Jr.
3,744,197 A * 7/1973 Wetzel, Jr. ..... E04B 1/0007 52/92.1
3,775,240 A * 11/1973 Harvey ..... B28B 19/00 52/206
4,295,810 A * 10/1981 Dennert ..... B28B 11/042 264/109
5,143,670 A * 9/1992 De Buzzaccarini ..... B28B 1/16 264/113
5,596,853 A * 1/1997 Blaney ..... E04C 2/044 52/223.7
6,125,608 A * 10/2000 Charlson ..... E04B 1/7604 52/404.1
6,282,853 B1 * 9/2001 Blaney ..... E04C 2/044 52/223.7
7,421,828 B2 9/2008 Reynolds
7,716,899 B2 * 5/2010 Beck ..... E04B 1/24 52/236.3
8,793,948 B2 * 8/2014 Beattie ..... E04B 1/26 52/267
8,844,227 B1 * 9/2014 Ciuperca ..... E04C 2/296 52/309.11
9,003,740 B2 * 4/2015 Ciuperca ..... E04C 2/296 52/745.05
9,151,053 B2 * 10/2015 Stephens, Jr. ..... E04C 2/52
(Continued)

FOREIGN PATENT DOCUMENTS

WO 03/008730 A1 1/2003

*Primary Examiner* — Rodney Mintz
(74) *Attorney, Agent, or Firm* — Maier & Maier, PLLC

(57) ABSTRACT

A method for producing a sustainable building without the use of heavy equipment. Such a building may include an adjustable foundation to eliminate the need to flatten the building surface below. The frame may be constructed by using hand tools to assemble pre-rolled galvanized steel rods. A pre-cut perforated galvanized steel sheet can then be laid on the frame and sheathed with a pre-mixed mortar that may be created by mixing materials easily found in impoverished countries, such as natural lime, river sand, white clay, and fly ash. The roof may be layered with a thin solar film to allow for the incorporation of solar cells to harness solar energy and may further include a rainwater collection mechanism to allow for the roof to also collect clean rainwater.

14 Claims, 4 Drawing Sheets

(56) References Cited

U.S. PATENT DOCUMENTS 9,290,939 B2 * 3/2016 Ciuperca ..... E04C 2/296
9,410,321 B2 * 8/2016 Ciuperca ..... E04C 2/296
9,702,498 B2 * 7/2017 Nieminen ..... B29C 44/352
9,745,749 B2 * 8/2017 Ciuperca ..... E04C 2/296
9,909,278 B2 * 3/2018 Morton ..... E04B 2/02
9,957,715 B1 * 5/2018 Carlson ..... E04C 2/296
9,982,433 B2 * 5/2018 Ciuperca ..... E04C 2/296
10,106,947 B2 * 10/2018 Morton ..... E04B 2/02
10,364,185 B2 * 7/2019 Mabey ..... C04B 28/065
2004/0200172 A1 10/2004 Beck et al.
2008/0016802 A1 1/2008 Rheaume
2009/0094927 A1 * 4/2009 Farrell, Jr. ..... E04C 2/044
52/583.1
2009/0217612 A1 * 9/2009 Window ..... E04B 5/04
52/414
2012/0079776 A1 * 4/2012 Beattie ..... E04B 1/26
52/90.1
2014/0033627 A1 * 2/2014 Stephens, Jr. ..... E04C 2/52
52/204.5
2014/0087158 A1 * 3/2014 Ciuperca ..... B32B 7/02
428/215
2014/0260034 A1 * 9/2014 Ciuperca ..... E04C 2/296
52/405.3
2015/0007524 A1 * 1/2015 Ciuperca ..... E04C 2/296
52/741.4
2015/0064436 A1 * 3/2015 Nieminen ..... B29C 44/352
428/220
2015/0076726 A1 * 3/2015 Mathieu ..... B29C 44/02
264/51
2015/0079356 A1 * 3/2015 Mathieu ..... E04C 2/049
428/192
2015/0204067 A1 * 7/2015 Binder ..... E04C 3/29
52/79.1
2015/0218809 A1 * 8/2015 Ciuperca ..... E04C 2/296
52/612
2015/0240483 A1 * 8/2015 Riepe ..... E04B 1/7604
52/309.12
2015/0308124 A1 * 10/2015 Newman ..... E04F 13/0862
52/747.11
2015/0315089 A1 * 11/2015 Lee ..... B28B 1/008
264/31
2016/0201327 A1 * 7/2016 Ciuperca ..... E04C 2/296
52/223.13
2016/0222651 A1 * 8/2016 MacKinlay ..... B32B 13/02
2016/0340901 A1 * 11/2016 Ciuperca ..... E04C 2/296
2017/0080614 A1 * 3/2017 Lamm ..... E04B 1/7604
2017/0247881 A1 * 8/2017 Morton ..... E04B 2/02
2017/0370101 A1 * 12/2017 Ciuperca ..... E04C 2/296
2018/0086667 A1 * 3/2018 Prante ..... C04B 28/02
2018/0148923 A1 * 5/2018 Bravo Valenzuela .... E04B 2/00
2018/0155246 A1 * 6/2018 Prante ..... E04B 1/163
2018/0155896 A1 * 6/2018 Morton ..... E04B 2/02
2018/0274234 A1 * 9/2018 Ciuperca ..... E04C 2/296
2018/0282218 A1 * 10/2018 Mabey ..... C04B 28/065
2019/0085557 A1 * 3/2019 Carlson ..... E04B 1/7612
2019/0118430 A1 * 4/2019 Lamm ..... E04B 1/7604

* cited by examiner

METHOD AND SYSTEM FOR CONSTRUCTION AND BUILDING

BACKGROUND

Traditional construction and building methodologies are heavily reliant on a variety of complex factors. Heavy machinery needs to be on the jobsite in order to dig a foundation, raise walls, mix and pump building materials, or flatten land. Skilled laborers are necessary to operate such machinery. This is inconvenient or impossible to do in many places where heavy machinery is not readily available, such as developing countries.

Additionally, conventional construction techniques often leave hollow walls. Expensive materials need to be imported to fill them. Current materials may crack and might not include access for water pipes and electrical components.

Filling these hollow walls requires materials that may be heavy and expensive. Impoverished countries lack the resources to import and install solid walls. Solid walls are sought after not only for their insulating and protective qualities, but also because of local stigma that makes solid walls more attractive to the consumer.

Traditional concrete offers little to no insulative properties, so insulation often needs to be separately installed. Traditional insulation techniques utilize large sheets of foam such as polystyrene. The sun and the elements can have a detrimental effect on polystyrene insulation over time. Insulation is also often susceptible to fire.

SUMMARY

A method for producing a sustainable building that may be constructed with solid filled walls and may not require the use of heavy equipment. Such a building may include an adjustable foundation to eliminate the need to flatten the building surface below. The frame may be constructed by using hand tools to assemble pre-rolled galvanized steel rods. A pre-cut perforated galvanized steel sheet can then be laid on the frame and sheathed with a pre-mixed mortar that may be created by mixing materials easily found in impoverished countries, such as natural lime, river sand, white clay, and fly ash. There may be a layer of light insulating cement created by mixing EPS 2-6 mm (0.0787-0.23622 inches) beads, a surface additive, cement, and water. It can be poured between the frame to fill the previously hollow walls. The light insulating cement creates solid walls which are lighter than traditional solid walls while also insulating the building. The use of EPS beads creates a cement that is physically lighter than traditional concrete, while also providing additional insulative properties that concrete does not contain. The filling creates an impression of solidity in the walls, giving the consumer confidence that the building is sturdy. Finally, a roof can be formed on site using pre-painted galvanized steel coils. The roof may be layered with a thin solar film to allow for the incorporation of solar cells to harness solar energy and may further include a rainwater collection mechanism to allow for the roof to also collect clean rainwater.

BRIEF DESCRIPTION OF THE FIGURES

Advantages of embodiments of the present invention will be apparent from the following detailed description of the exemplary embodiments thereof, which description should be considered in conjunction with the accompanying drawings in which like numerals indicate like elements, in which.

DETAILED DESCRIPTION

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage or mode of operation.

According to an exemplary embodiment, and referring generally to the Figures, a method and system for constructing a sustainable building, as well as various components and elements of a building, may be shown and described.

According to an exemplary embodiment, a building, which may be any type of residential or commercial building meant to be permanent or semi-permanent, may incorporate a foundation which may be formed with pre-shaped galvanized steel rod footing slab. Such a slab may be layered with a recycled plastic mold which, in turn, may be shaped and formed to allow for implementations such as water pipes to run underneath, and may be additionally layered with a light insulating concrete. The foundation may be raised to a height which may be adjusted along different parts of the foundation. This can allow the foundation to be adjusted to compensate for an uneven building surface without requiring that the surface be flattened or leveled using heavy machinery. The foundation may be adjusted by increasing or decreasing the height of the galvanized steel rods in a single section without adjusting the galvanized steel rods in another section or part of the foundation. Further, the foundation may physically raise the ultimate structure from the ground, creating a workable crawlspace for maintenance as well as offering protection from Radon gas and provides insulation.

Figure 1A:
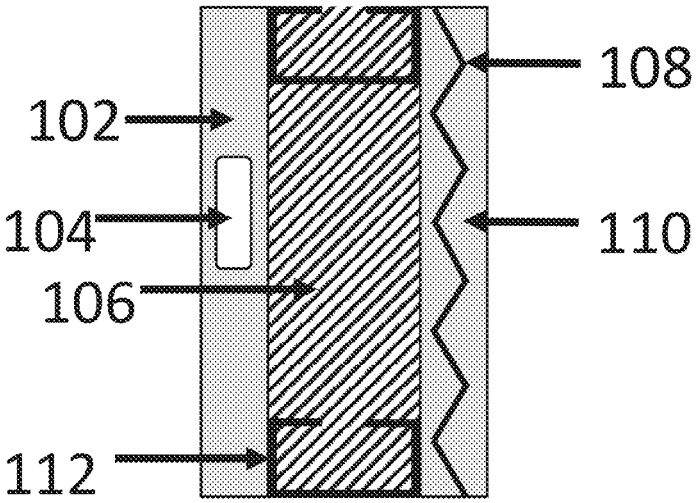
FIG. 1A is an exemplary embodiment of an overhead view of a cross-section of a wall.
Figure 1B:
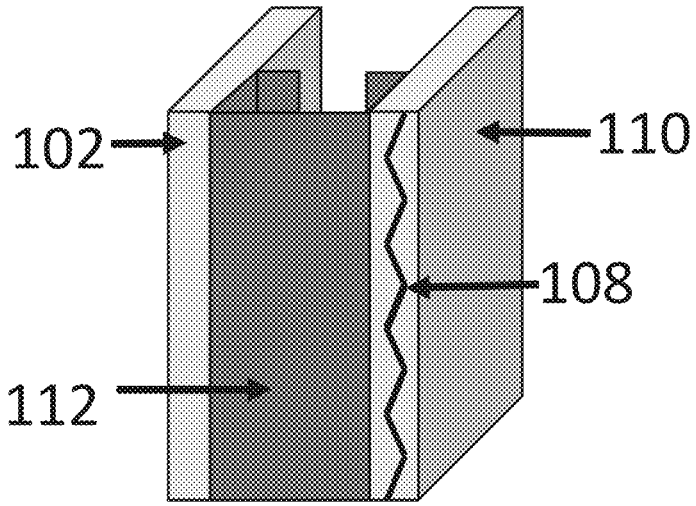
FIG. 1B is an exemplary embodiment of a vertical cross-section of a wall.

Turning now to exemplary FIG. 1, this figure shows a cross-section of a wall that may be implemented in a sustainable building. The wall can include a stud 112, which may be formed, for example, from galvanized steel. Stud 112 may be attached to two plaster outer layers on opposite sides, such as interior wall 102 and exterior wall 110. The exterior wall 110 may be reinforced in a variety of manners, such as the utilization of a perforated galvanized steel sheet 108, which may be rib-Lath. The interior wall 102 may be pre-cladded and include any number of holes or apertures 104. The holes or apertures 104 may be sized in any of a variety of dimensions, for example sized to accommodate the running electrical wiring, cable, and/or plumbing. Further, the wall 100 may be filled with an insulator mixed with a surface additive to create a light insulating concrete 106. The light insulating concrete may include, but is not limited to, materials such as EPS 2-6 mm (0.0787-0.23622 inches) beads, cement, and water. The light insulating concrete 106 is different than traditional insulators due to its strength and rigidity. The light insulating concrete 106 creates solid walls which can endure the elements and are more attractive to consumers in many developing areas where the strongest possible walls provide enhanced durability and insulation when compared to hollow walls.

According to an exemplary embodiment, a building may use a frame 112 implementing pre-rolled beams made of a metal such as galvanized steel, which is inexpensive but strong. Pre-rolled beams are easily transportable, inexpensive, and provide sufficient and desired structural support. Once the beams are rolled, machinery may no longer be utilized, and the beams can then be assembled into a frame 112 using only hand tools. The frame 112 may include interior pre-cladding and holes or apertures for running electrical wiring and plumbing, such as those shown above with respect to wall 100. The exterior of the frame 112 pre-cladding may be reinforced with rib-lath, or another perforated galvanized sheet, as desired.

The exterior 110 of wall 100 may be sheathed with pre-mixed mortars and plaster which may be formed by mixing materials such as natural lime, river sands, white clay, fly ash, or air integrators, which may be sourced in locations physically close or proximate to desired construction site or sites. The pre-mixed mortars and plaster may be produced on site. Such sourcing and formation may eliminate the need for heavy machinery to produce and transport these materials. Further, the materials may be considered sustainable and avoid undesired chemicals or industrial processes.

According to an exemplary embodiment, a building may be constructed with a roof which may use slap, clip, or click type, or any other type, as desired, of pre-painted galvanized roof sheet which may additionally hold a thin solar film and may be designed and/or utilized to harvest rainwater.

Figure 2:
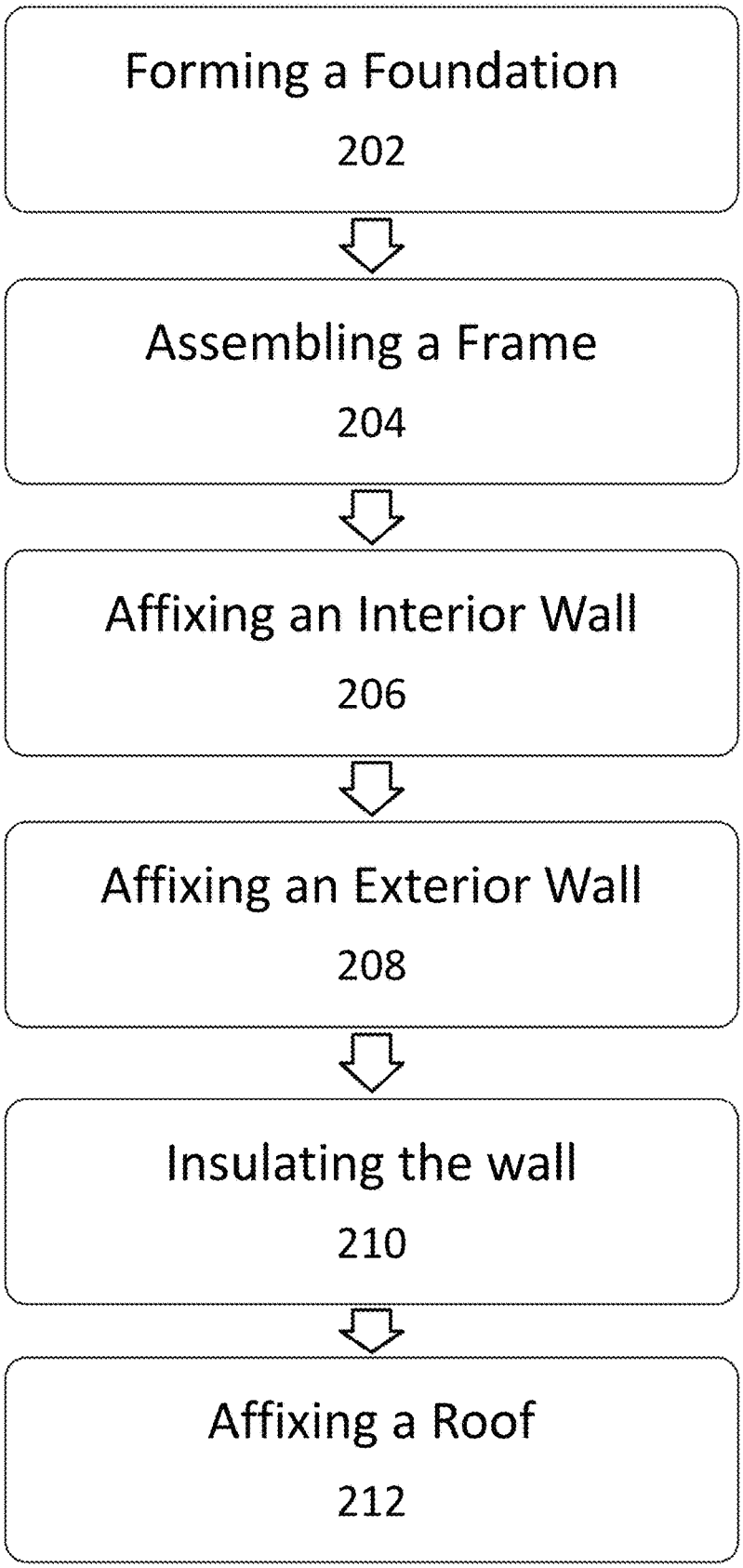
FIG. 2 is an exemplary embodiment of a method of building.

Referring now to exemplary FIG. 2, a method for constructing or forming a building, may be shown and described. According to the exemplary embodiments, the building may be such that it is permanent or semi-permanent and capable of withstanding a wide variety of weather and climate conditions. Further, the building may be utilized or designed to suit any traditional residential or commercial purposes, as desired. Further, based on the exemplary method, the building may be formed quickly, economically, and in an environmentally-friendly manner. For example, the building can be formed without the use of heavy machinery, may include many locally-sourced components and elements, and may be done by workers with minimal training or traditional construction skill. According to the exemplary method in 202, a foundation may be formed. The foundation may include a pre-formed steel frame. Further, the steel frame can be formed and positioned such that the ultimate structure is raised off the ground, insulating the structure from radon gas and heat or dissipating to or from the ground. Further, the foundation may be adjusted at different points to compensate for an uneven building surface. Thus, as desired, various locations where traditional foundations would not be suitable or possible may be utilized in the formation of the foundation described herein.

In a further exemplary embodiment, a plastic molding may be layered above the frame. The plastic molding may be shaped in such a way that allows for plumbing and wiring to pass underneath, as desired. Also, in some exemplary embodiments, a layer of light concrete may be poured over the plastic molding to provide an even, insulated surface.

Next, in 204, a frame for the building may be formed or assembled. For example, the frame may be assembled using pre-rolled galvanized steel rods. Due to the size and characteristics of these rods, they may be easily transported and manipulated without the need for heavy machinery. These may be assembled without the use of heavy machinery and may only require the use of hand tools, which can further increase the sustainability of this construction and reduce the ecological footprint of such projects. The lack of use of heavy machinery for the construction also allows for less skilled workers to construct the building, further increasing accessibility of the project to impoverished areas.

The galvanized steel frame formed in 204 may be enclosed by the formation of two walls, the forming of an interior wall in 206 and the forming of an exterior wall in 208. The formation of the interior wall in 206 may be supported by pre-cladding for strength and insulation. An exemplary embodiment may further include holes or apertures of various sizes inside the interior wall to allow for piping or wiring to pass through. It is envisioned that any number of holes or apertures may be utilized, and that the holes and apertures may be sized and located in any location, for example traditional locations for the placement of wiring and/or piping.

The formation of the exterior wall in 208 may utilize a perforated galvanized sheet such as rib-lath which then may be sheathed with a plaster. The plaster may be made by mixing locally sourced materials such as natural lime, river sand, white clay, and fly ash. The use of natural and easily accessible materials proximate the construction location can allow for builders in impoverished or developing countries to easily construct the exterior walls.

In between the interior and exterior walls, the building may further incorporate a layer of insulation in 210. The insulation may be a light concrete mixture that may be applied between the two walls. The light concrete may be a mixture of expanded polystyrene such as EPS 2-6 mm (0.0787-0.23622 inches) beads, a surface additive, cement, and water. While traditional concrete is not considered as an effective insulator, the use of EPS beads or a similar lightweight insulating aggregate allows for the concrete formed in 210 to act as an insulator in hot or cold environments, while still providing the solidity and desired characteristics of traditional concrete. Thus, this formation in 210 increases efficiency of the exemplary building constructed by decreasing energy used for heating or cooling the home. Traditional EPS insulators utilize foam boards which are easily damaged by the elements and might melt or catch fire. Furthermore, the foam boards offer no rigidity or protection against physical threats, whereas the light concrete mixture will provide rigidity by filling the walls with solid concrete. Consumers also often associate solid walls as an indicator of a strong building, as opposed to hollow walls. A further advantage demonstrated by step 210 is that the light concrete mixture can be formed without any heavy machinery and may be pre-mixed or mixed on the job site, instead of requiring a mixing truck and/or transport from a remote location.

Figure 3:
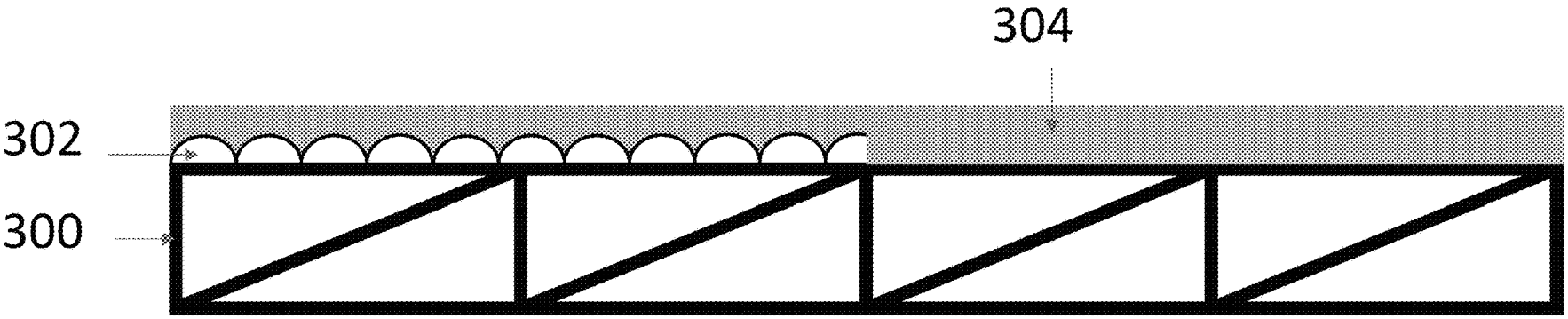
FIG. 3 is an exemplary embodiment of a foundation.

Next, in 212, a roof may be formed using slip, clip, or click roofing, as desired. These types of roofing are relatively light weight and easily manipulated. Thus, in 212, the roof can be assembled by hand without any heavy machinery. Also, the roof elements may have minimal maintenance needs while, at the same time, providing both extreme resistance to high winds and a high fire rating. They can be formed on site using metal sheets such as pre-painted galvanized steel coils. This type of roofing provides a surface that can easily hold and/or support additional structures. The roof may further include a layer of solar film, such as thin-film solar cells, which may harvest solar energy in an inexpensive way without adding significant weight to the roof, further increasing the sustainability and efficiency of the building. Another exemplary embodiment may include a rainwater collection mechanism to collect rainwater, which provides an important benefit to consumers who may be in developing and/or impoverished area and further increases sustainability. Exemplary FIG. 3 provides an exemplary embodiment of a foundation upon which the sustainable building described in various exemplary embodiments herein may be constructed. The foundation may include galvanized steel beams 300 which can act to raise the foundation to raise it off the ground. These steel beams can be adjusted to compensate for an uneven building surface, whereas traditional foundations require the use of heavy machinery to flatten ground on land that isn't naturally suitable for construction. The adjustable height allows for construction in areas where it would not ordinarily be ideal and does not require the land to be flattened using heavy machinery and skilled workers, which might not be readily available in many impoverished areas. The beams may be pre-formed using a roll former and then sent to the job site to be assembled and adjusted. The rods can easily be manipulated using hand tools, further reducing the need for heavy machinery. They can be easily transported due to their size and shape. A plastic molding 302 may be layered above the frame. The plastic molding may be shaped in such a way that allows for plumbing and wiring to pass underneath, as desired. Further, a layer of light concrete 304 may be poured over the plastic molding to provide an even, insulated surface.

Figure 4:
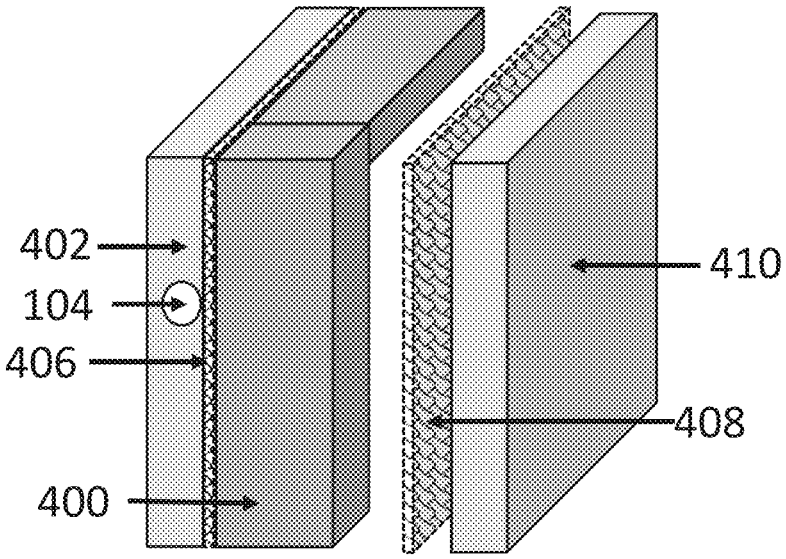
FIG. 4 is an exemplary embodiment of a vertical cross-section of a wall.

Referring now to exemplary FIG. 4, an alternate embodiment of a wall may be shown and described. The frame of the wall may be made of a metal beam 400 to form a lightweight frame. The metal beam 400 may be formed from galvanized steel or another metal with similar properties. Galvanized steel beams are easily transportable, strong, and can easily be assembled into a frame without the use of heavy machinery, which can further increase the sustainability of this construction and reduce the ecological footprint of such projects. The lack of use of heavy machinery for the construction requires fewer skilled workers to construct the building, further increasing accessibility of the project to impoverished areas. A computer aided machine can roll and cut the studs to a pre-determined specification, allowing for the frame to be assembled using just hand tools and without the need for heavy machinery. The pre-cut light steel frame may reduce worker error and labor by eliminating the need for workers to cut and fit the metal for the frame, as is required by the traditional cut and fit stud system.

Surrounding the metal beam may be two layers of lath 406 and 408. The lath 406 is on the interior side of the beam, and the lath 408 is on the exterior of the beam. The lath may be a perforated metal sheet or any other lath that can support plaster. A rib-lath made of galvanized steel may be used since it is inexpensive and lightweight. The lath may be affixed to either side of the frame using hand tools. The lath 406 supports the plaster interior wall 402, and the exterior lath 408 supports the exterior wall 410. The lath increases the longitudinal strength of the frame, thus reducing the number of studs needed to support the structure. By reducing the number of studs, the overall cost of the project may be decreased.

The interior and exterior walls 402 and 410 may be formed using the same light insulated plaster. A light insulated plaster can be made by mixing local materials to create a concrete mixture, such as by mixing lime, cement, water, and additionally adding polystyrene beads to the plaster mixture for insulation. The addition of lime may prevent the plaster from cracking over time while also protecting the building from harmful bacteria and fungus. Further, these ingredients may be locally sourced as they are found naturally in many developing or impoverished countries. This makes the project more accessible to these countries and reduces the ecological impact of the project by avoiding undesired chemical or industrial processes. Furthermore, this wall benefits over traditional walls because it does not require an additional layer of insulation and may be lighter than traditional Portland cement and sand plasters.

The polystyrene beads found in walls 402 and 410 may provide the insulation that plaster traditionally lacks. 2-4 mm (0.0787-0.23622 inches) expanded polystyrene (EPS) beads may be used. Traditional walls require a solid outside layer of plaster or concrete that protects a soft inner-layer of insulation. By combining the two layers into a single plaster, the wall 410 can provide both insulation and protection while reducing the amount of time and labor required to assemble the wall. Developing countries often lack skilled laborers and will benefit from the decreased workload. The cost of the building may be reduced by eliminating the need for separate insulation, such as an insulating foam board. Further, a large volume of insulating foam boards may be difficult to obtain in developing countries whose inhabitants may not have the means or budget to import such a volume.

A further exemplary embodiment of 402 and 410 may include a plaster mixed with a special light mortar which further incorporates a chemical air integrating agent to further reduce weight. The reduction of weight further reduces the number of studs required for the frame, thus reducing costs and labor required for assembly. Further, the addition of the air integrating agent reduces the overall cost of the mortar and plaster itself by diluting the previous mixture. The air integrating agent allows humidity to escape and may improve elasticity and coherence.

A further exemplary embodiment may incorporate one or more additional levels or stories above the first structure. The additional level or levels may be formed by the same lightweight frame and plaster used previously.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art (for example, features associated with certain configurations of the invention may instead be associated with any other configurations of the invention, as desired).

Therefore, the above-described embodiments should be regarded as illustrative rather than restrictive. Accordingly, it should be appreciated that variations to those embodiments can be made by those skilled in the art without departing from the scope of the invention as defined by the following claims.

The invention claimed is:

1. A method of constructing a building, comprising:

assembling a first plurality of pre-formed metal rods over a building surface to form a foundation, creating a floor by affixing a plastic molding to the first plurality of pre-formed metal rods, spreading a light concrete over the floor;

attaching a second plurality of pre-formed metal rods in a predetermined manner to form a frame with an interior portion and an exterior portion;

attaching a first lath to the interior portion of the frame;

spreading a light plaster over the first lath; wherein the light plaster is composed of a mixture of an insulator, an air integrator, cement, and water; wherein the insulator is expanded polystyrene beads; wherein the air integrator is at least one of natural lime, river sands, white clay, and fly ash;

attaching a second lath to the exterior portion of the frame;

spreading the light plaster over the second lath; and coupling a plurality of metal sheets to a top portion of the frame to form a roof.

2. The method of constructing a building of claim 1, wherein the expanded polystyrene beads are 2-6 mm (0.0787-0.23622 inches) expanded polystyrene beads.

3. The method of constructing a building of claim 1, further comprising:

cutting the first plurality of metal rods and the second plurality of metal rods into predetermined lengths; and assembling the first and second plurality of metal rods into a predetermined frame shape.

4. The method of constructing a building of claim 1, further comprising constructing a wall by:

attaching the first lath to the frame; and spreading the light plaster on the first lath.

5. The method of constructing a building of claim 1, wherein the light plaster is mixed with a light mortar which further incorporates a chemical air integrating agent that reduces a weight of the plaster.

6. The method of constructing a building of claim 1, wherein the foundation is raised above the building surface, creating a space between the building surface and the floor.

7. The method of constructing a building of claim 1, further comprising attaching solar cells and a rainwater collection system to the roof.

8. The method of constructing a building of claim 1, further comprising leveling the building surface, wherein the first plurality of pre-formed metal rods are formed with different lengths and assembled over the building surface to level an uneven building surface.

9. The method of constructing a building of claim 1, further comprising forming the first and second pluralities of pre-formed metal rods by:

shaping a metal sheet into metal rods using a roll-former; and cutting the shaped metal rods into predetermined lengths.

10. The method of constructing a building of claim 1, wherein the first and second pluralities of pre-formed metal rods are formed from galvanized steel.

11. The method of constructing a building of claim 1, wherein the plurality of metal sheets is formed from galvanized steel.

12. The method of constructing a building of claim 1, wherein the plurality of metal sheets includes flanges on opposite sides of each sheet which overlap with adjacent panels to form the roof, wherein the roof is a standing seam roof.

13. The method of constructing a building of claim 1, further comprising filling an area inside the frame between the first lath and the second lath with the light concrete.

14. The method of constructing a building of claim 13, wherein the light concrete comprises cement, lime, water, and an insulator.

* * * * *